US005390743A

United States Patent [19]

Giannesini

[11] Patent Number: 5,390,743

[45] Date of Patent: Feb. 21, 1995

[54] INSTALLATION AND METHOD FOR THE OFFSHORE EXPLOITATION OF SMALL FIELDS

[75] Inventor: Jean-François Giannesini, Saint Cloud, France

[73] Assignee: Institut Francais Du Petrole, Rueil Malmaison, France

[21] Appl. No.: 104,571

[22] Filed: Aug. 11, 1993

[30] Foreign Application Priority Data

Aug. 11, 1992 [FR] France ..... 92 09988

[51] Int. Cl.[6] ..... E21B 43/017

[52] U.S. Cl. ..... 166/366; 166/352

[58] Field of Search ..... 166/352, 353, 354, 355, 166/357, 366

[56] References Cited

U.S. PATENT DOCUMENTS

| | | | |
|---|---|---|---|
| 4,527,632 | 7/1985 | Chaudst | 166/357 |
| 4,896,725 | 1/1990 | Parker et al. | 166/267 |
| 4,967,843 | 11/1990 | Corteville et al. | 166/366 |
| 5,226,482 | 7/1993 | Giannesini et al. | 166/353 |

FOREIGN PATENT DOCUMENTS

| | | | |
|---|---|---|---|
| 0470883 | 2/1992 | European Pat. Off. . | |
| 2148202 | 5/1985 | United Kingdom . | |
| 2215408 | 9/1989 | United Kingdom . | |
| 2257449 | 1/1993 | United Kingdom . | |
| 8810397 | 12/1988 | WIPO | 166/357 |
| 8912728 | 12/1989 | WIPO . | |

*Primary Examiner*—Hoang C. Dang

*Attorney, Agent, or Firm*—Antonelli, Terry, Stout & Kraus

[57] ABSTRACT

System for optimizing the development of small oil deposit comprising a main platform, a floating structure including pumping means, the system being positioned close to at least one production wellhead, mechanism for transferring the effluents from said well towards the floating structure and from the floating structure to the main platform. The system comprises a device for taking a sample of a fluid from said effluents and at least one device for injecting said fluid at the level of the wellhead.

The method comprises a stage of transfer of the effluents of a deposit towards a floating structure located close to the deposit, taking a sample of fluid from the effluents, reinjecting this sample of fluid at the level of an immersed wellhead and transferring the effluents towards the main platform.

11 Claims, 3 Drawing Sheets

INSTALLATION AND METHOD FOR THE OFFSHORE EXPLOITATION OF SMALL FIELDS

FIELD OF THE INVENTION

The present invention relates to a method and to a system for developping small oil deposits.

The present invention is more particularly applied to the development of oil deposits located at great depths.

The method and the system are notably applied to the development of marginal oil deposits having a low production capacity and located at variable depths.

BACKGROUND OF THE INVENTION

The discovery of new gas and oil deposits of low production capacity, located at variable depths and in zones presenting difficult development conditions, has led to use new technologies allowing the running costs to be reduced for these deposits. Thus, the use of conventional fixed platforms seems to be increasingly abandoned for lighter floating platforms which are used as intermediate stations for the transportation or transfer of the effluents.

Patent FR-2,665,725 and patent application EN-91/04,223 filed by the applicant teach to use floating systems for the transfer of multiphase effluents, without separation of their constituents, from a deposit towards a main treatment platform with the aid of pumping means positioned on the floating system or intermediate floating station. However, this method requires a sufficient pressure at the outlet of the immersed wellhead, not only to allow the effluent to flow up from the sea bottom towards the floating system, but also for the effluents to have thereafter a sufficient pressure level allowing the pumping means located on the intermediate floating station to communicate them a pressure increase enabling their transfer over a given distance from the intermediate station towards a treating station. The pressure of the effluent at the inlet of the pumping means depends on the characteristics of the well (very eruptive well or not) and also on the depth at which the deposit is located.

The devices described in the prior art cited above have practically no effect on the effluent, notably on the pressure drop occurring during its upflow between the well and the light structure.

It is therefore necessary to have a system and a method allowing this pressure drop to be compensated for.

SUMMARY OF THE INVENTION

The object of the present invention is to overcome the drawbacks mentioned above and to provide a system and a method allowing to get free at the maximum from the specific parameters of the effluents, and notably from the value of the pressure of the effluent at the outlet of the production wellhead, so as to widen the development field of marginal oil fields.

More particularly, for the production of multiphase oil effluents, the object of the system proposed is to facilitate the upflow of the effluents, for example oil, gas and water, coming from the production well or wells and thereby to compensate the pressure variation undergone by the effluent during its transfer from the production well towards the floating structure in order to have, at the inlet of the pump included in the pumping means, an effluent whose pressure value is sufficient for the pump to be able to transfer it over a given distance.

The present invention relates to a system for optimizing the development of effluent fields located below a water layer communicating by means of at least one production well, comprising in combination a main platform equipped with means for treating the effluents coming from at least one of said fields, at least one floating structure including pumping means, said structure being positioned substantially close to at least one head of at least one of the effluent production wells, first transfer means for transferring the effluents from at least one of said production wells towards said floating structure and second transfer means for transferring said effluents from the floating structure towards the main platform. It is characterized in that it comprises at least one means for taking a sample of fluid from said effluents and at least one injection line for injecting said fluid, said injection line comprising a first end connected to said floating structure and a second end located substantially at the level of the production wellhead so as to inject said fluid taken thereby.

The second end of the fluid injection line may be connected to the base of the first means for transferring the effluents.

The second end of the fluid injection line may be connected to the base of the first means for transferring the effluents by means of a device for regulating the flow of the fluid injected.

The fluid taken may be part of the gas phase of the effluent and the injection line for injecting the gas phase may consist of a production umbilical or a riser.

The pumping means located on the floating structure may include at least one multiphase pump (P) and the first end of the fluid injection lines may be connected to the outlet of said pump (P).

The floating structure may comprise at least one device for regulating and reducing the fluctuations of the effluent, and the first end of the fluid injection lines may be connected to the fluctuation regulating and reducing device.

The system may comprise means for anchoring the floating structure close to a field.

The present invention further relates to a method for developping and optimizing the oil-deposit development located below a water layer communicating through at least one immersed wellhead. This method may comprise the following stages:

- positioning temporarily a floating structure close to at least one oil-deposit and transferring the effluents coming from said oil-deposit towards the floating structure with the aid of first transfer means,
- taking a sample of a fluid from said effluents,
- reinjecting the sample of fluid at the level of said immersed production wellhead, said injected sample of fluid favouring the up,flow of the effluents, and
- transferring at least part of said effluents towards a main plat form.

The first transfer means having a first end and a second end opposite the first one, said sample of fluid is injected at the level of the lower end of the first transfer means connected to the production wellhead.

A gas phase is used as a fluid to favour the upflow of the effluents coming from the production wellhead.

The floating structure being equipped with pumping means including at least one pump (P), the gas phase is taken at the outlet of said pump.

The floating structure being equipped with at least one device for regulating the fluctuations of the effluents, the gas phase is taken at the level of said device.

BRIEF DESCRIPTION OF THE DRAWINGS

Other features and advantages of the invention will be clear from reading the description hereafter given by way of non limitative examples, with reference to the accompanying drawings illustrating various embodiments and in which.

DESCRIPTION OF THE PREFERRED EMBODIMENTS

The system according to the invention and its implementing consist in taking a sample of a gas phase or gas, either upstream from a pump equipping a floating structure, or downstream therefrom, and in reinjecting this gas by means of a line connecting the floating structure to a production riser, substantially at the level of the base of the riser. The gas is recompressed when necessary.

Figure 1:
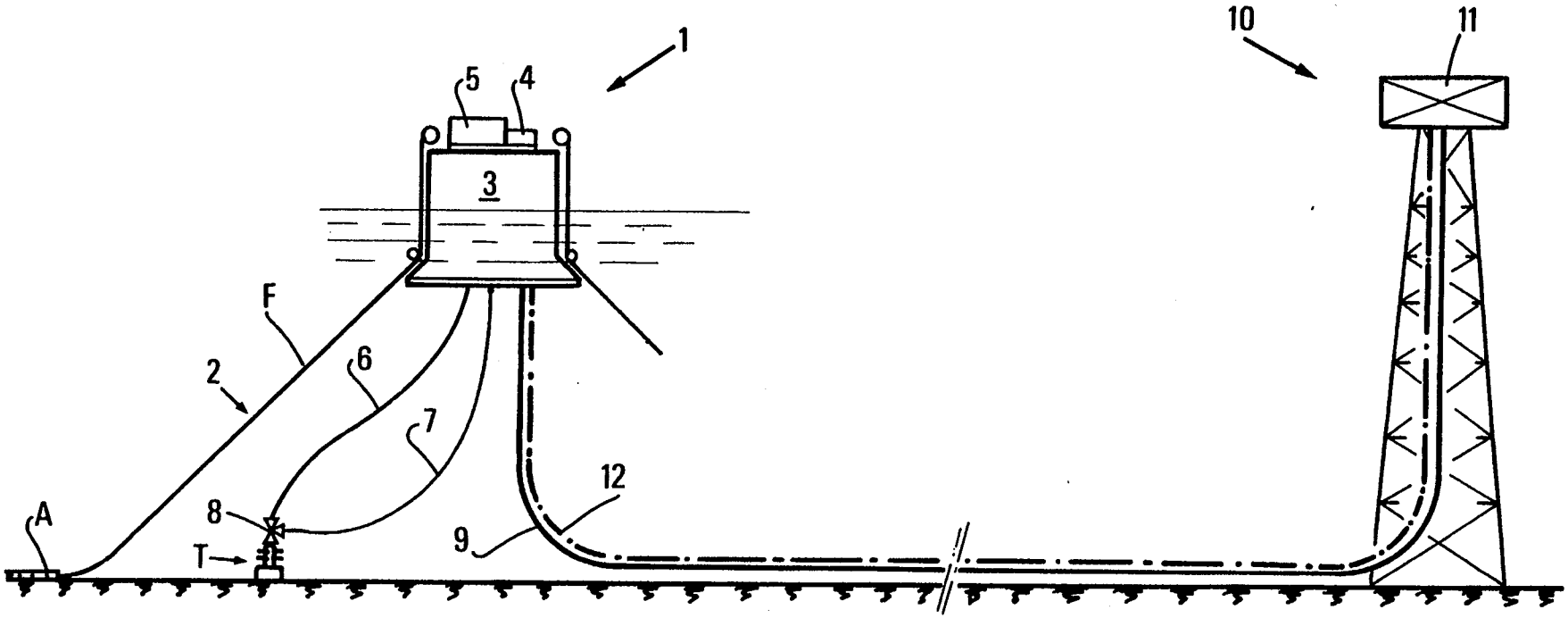
FIG. 1 is a schematic view of a device in accordance with the invention.

FIG. 1 shows an example of device 1 for the development, in accordance with the invention, of a production field including several small fields.

The device 1 or intermediate floating station is positioned above or close to the wells for placing in production the fields to be developped with the aid of anchoring means 2, preferably of the catenary type, including for example flexible cables or lines F and anchors A. The intermediate floating station 1 for transferring the effluents comprises a floating structure 3, such as a buoy, equipped with means for transferring the effluents, for example a pumping assembly 4 and a device 5 for recovering or taking a sample of fluid, such as gas, at any point of pumping assembly 4. The floating structure 3 is connected on the one hand to the head T of each production well through first means 6 for transferring the effluents, such as a line or riser and, on the other hand, to the base of the first transfer means 6 by an umbilical 7 for injecting a fluid favouring the upflow of the effluents from the production well towards the intermediate transfer station 1. The injection umbilical 7 is itself connected to the wellhead T by a regulating system 8 working from pressure measurements taken at the riser base and at the surface and allowing, among other things, adjustment of the amount of gas to be injected. The pressure measurements are performed by means of devices, not shown in the figure, which are usually utilized in the petroleum industry. Second transfer means 9 enable the effluents to be conveyed by the pumping assembly 4 from the intermediate station 3 towards a main treatment platform 10 or a storage place. The functional unit 11 diagrammatically shows all the development and treatment means located on the main platform 10 and commonly used in the profession.

The pumping assembly 4 comprises for example a pump P and its associated implementing means. These means comprise, for example, the devices necessary to the operation of the pump, such as a motor, devices for controlling and regulating the pump and the motor, and all the devices necessary to ensure proper working. The pump is preferably of the multiphase type.

The system further comprises pressure sensors Cp, of a type known by the man skilled in the art, located respectively at the level of the wellhead T and of the pump P, for example at the inlet thereof.

One possibility for implementing the development method according to the invention comprises, for example, the following stages:

1) positioning and anchoring, with the aid of anchoring means 2, the floating structure 3 above or close to the production well or wells included in the field to be developped,
2) taking a sample of a fluid from the effluent coming from said pool,
3) injecting the sample of fluid taken, for example a gas phase or gas, through the injection umbilical 7 at the base or lower end of the first means 6 for transferring the effluents and driving the effluents upwards to the floating structure 3 through these first transfer means 6, the function of the injection of gas being to favour the upflow of the effluents while lightening the effluent. This technique is often referred to as a "gas lift";
4) transferring the effluents from the floating structure 3 towards the treatment platform 10, for example by means of the pumping assembly 4 located on the floating structure, through second transfer means 9 such as a line or a pipe,
5) displacing the floating station 1 provided with various means for transferring the effluents, with anchoring means and with the injection umbilical for injecting the fluid taken, at the end of the development of the production field, towards another field to be developped, simply by exerting a traction on the flexible anchor line.

Another possibility consists in leaving the transfer means at the sea bottom and in displacing only the floating station provided with the injection umbilical for injecting the fluid taken.

Transferring the effluents from the floating structure towards the treatment platform is preferably achieved without separation of the constituents.

During the development of the production field, various controls of the running of the pumping assembly and of the production wells are performed; these controls being well known by the man skilled in the art, they will not be detailed in the present description.

A material line 12 used to send remote control signals allowing the various controls to be achieved or supervision and control of the development procedures connects the floating structure 3 to the treatment platform 10.

Similarly, the signals could be sent by any other means known by the man skilled in the art.

The system 8 for regulating the injection of gas is, for example, a variable-section choke when the gas is fed into the injection umbilical continuously.

When an intermittent gas lift method is used, the regulation system 8 may be a device for adjusting the duration and the periodicity of the injections this device being commonly used in oil development.

The gas injected at the base of the first transfer means comes from various sources as shown in the description hereafter.

Figure 2:
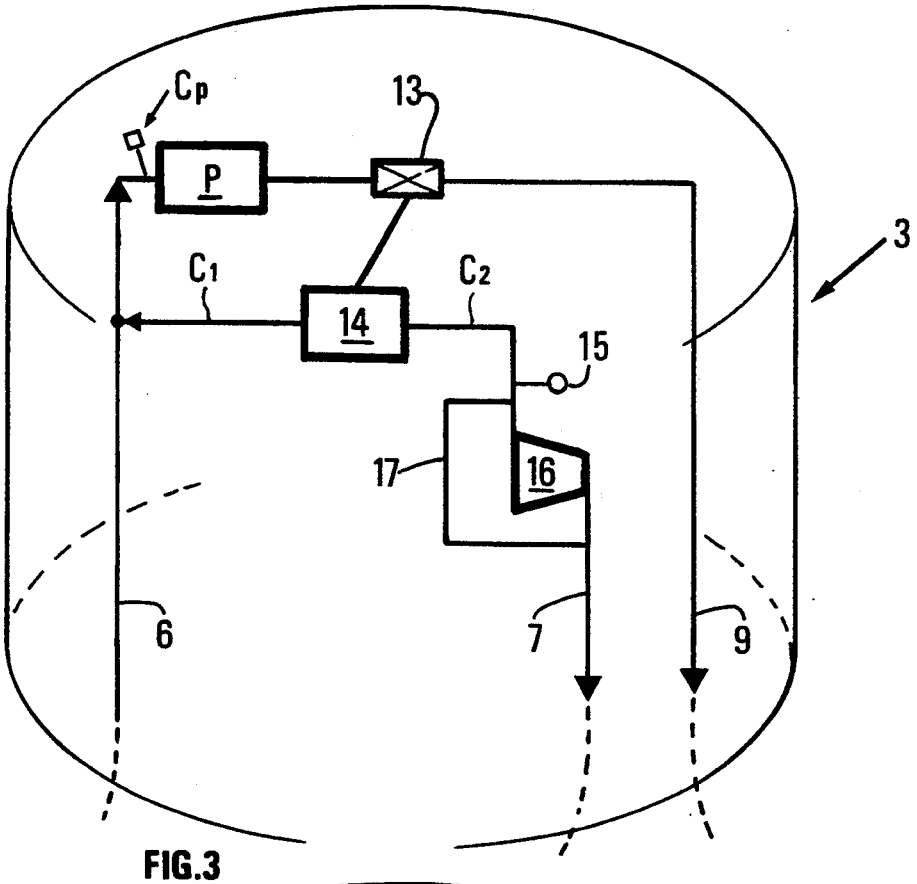
FIG. 2 shows an example of the embodiment of the device in which gas is taken at the outlet of a pump.

According to the embodiment of FIG. 2, the gas or gas phase used to favour the upflow of the effluents in the first transfer means 6 is taken at the outlet of pump P. The effluents coming from a production well are flown up towards the floating structure 3 by means of transfer means 6, up to pump P. A device 13 located downstream from the pump allows a given amount of the effluent which has passed through pump P to be taken. This system for taking a sample of a multiphase effluent may be of the simple or concentric tap type. The sample of effluent taken is then flown into a device 14 for separating it into a part mainly consisting of gas and a part rich in liquid. This device comprises, for example, a separating drum. The part rich in liquid is led towards the inlet of pump P or carried off towards another place through a line $C_1$. The part mainly consisting of gas is run by means of a reinjection circuit towards the injection umbilical 7 in order to be admixed with the effluent coming from the well. Mixing is achieved substantially at the level of the first transfer means. The circuit for reinjecting the gaseous part of the effluent comprises a line $C_2$ connecting the separating device 14 to the injection umbilical 7 by means of a compressor 16 which recompresses the effluent if need be, or connecting device 14 directly to the injection umbilical 7 by means of a bypass 17. A pressure sensor 15 located before the compressor allows the value of the pressure of the gaseous part of the effluent to be determined. If this value is less than a determined threshold value, the gas phase of the effluent passes through compressor 16, and if it is higher, the gas phase is run directly into the injection umbilical 7 through bypass 17 and admixed with the effluent coming from the well by means of regulation system 8.

Figure 3:
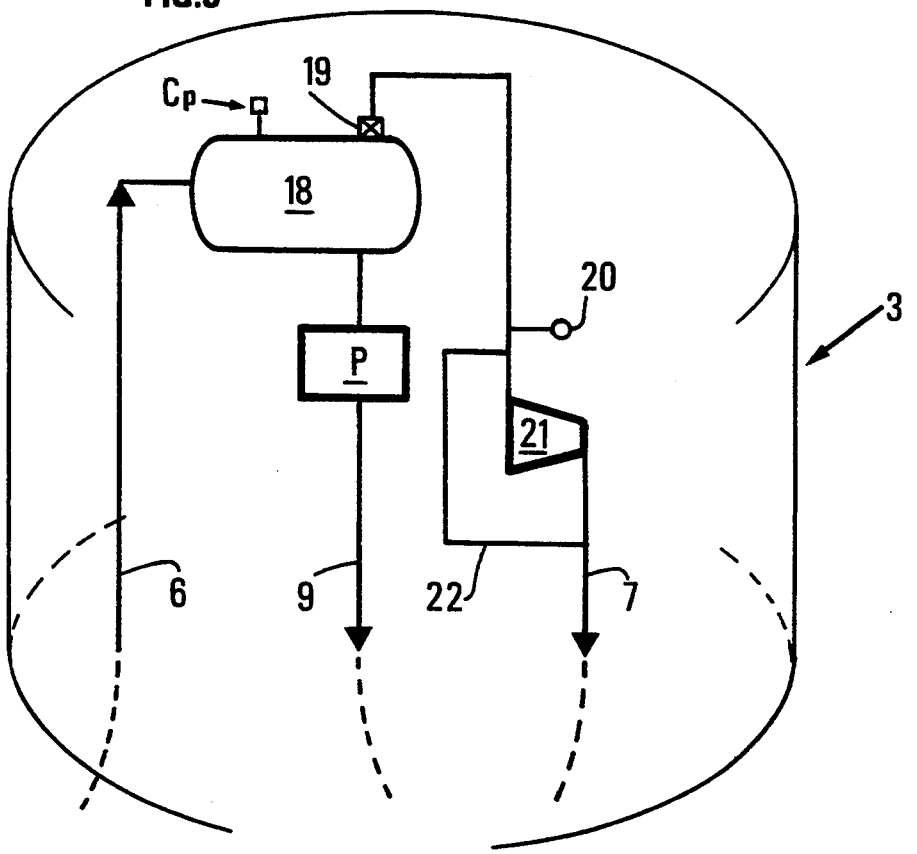
FIG. 3 shows the device in accordance with the invention in which gas is taken at the level of a device regulating the fluctuations of the effluents.

FIG. 3 diagrammatically shows another embodiment of the invention, more particularly suited to a floating structure, whose pumping assembly includes a drum allowing regulation and damping of the effluent fluctuations or regulating drum.

According to this figure, the effluents flow up from the production well by means of the first transfer means 6 up to a regulating drum or surge drum 18 located on the floating structure 3, positioned before pump P and equipped with a pressure sensor Cp. The surge drum is provided with a gas catcher 19 located preferably in its upper part and allowing a certain amount of gas phase or gas to be taken. This gas phase is thereafter run into the injection umbilical 7 by means of a reinjection circuit allowing the gas to be recompressed if need be. The reinjection circuit includes a pressure sensor 20, a compressor 21 and a bypass 22 for this compressor. In case the gas pressure is less than a certain threshold value, the gas passes directly through the bypass. When the value of the gas pressure is insufficient, the gas is recompressed in compressor 21 and then run into the injection umbilical 7 before being admixed with the effluent coming from the well by means of regulation system 8.

In this case, the gas phase is reinjected without passing through pump P.

In the two examples described in FIGS. 2 and 3, the gas or gas phase must have a certain pressure value to fulfil its purpose and help towards the upflow of the effluents, or to fulfil the part of a gas lift. Thus, the threshold value of the pressure necessary for the gas to fulfil its gas lift function is calculated by taking into account the pressure drops due to the circuit followed by the effluent from the wellhead T to the floating structure 3, the initial pressure of the effluent at the level of the wellhead, the pressure in the drum and the pressure at the level of the pump. These values are given by pressure sensors Cp. The measured pressure values and the estimated pressure drop values are sent to a computing and control device, for example a processor or microcomputer not shown in the figure, which determines the pressure value which should be communicated by the compressor. The pressure of the compressor is adjusted so as to communicate to the gaseous part of the effluent taken the pressure complement which will enable it to fulfil its purpose and help towards the upflow of the effluent.

The calculation of the amount of gaseous part to be injected is well-known by specialists and will therefore not be described here.

Without departing from the scope of the invention, a device such as a microcomputer equipped with a conventional data acquisition card and with an appropriate software, connected to the various measuring devices by means of electric links, may be used and will allow the pressure of the compressor to be adjusted automatically.

Similarly, without departing from the scope of the invention, this device may be connected to the device 8 for regulating the flow of gas so as to control the amount of gas to be injected into the injection line.

Of course, the separating drum 18 may be replaced by any other device fulfilling the same separation purpose, such as for example that described in French patent FR-2,513,534, without departing from the scope of the present invention.

Figure 4:
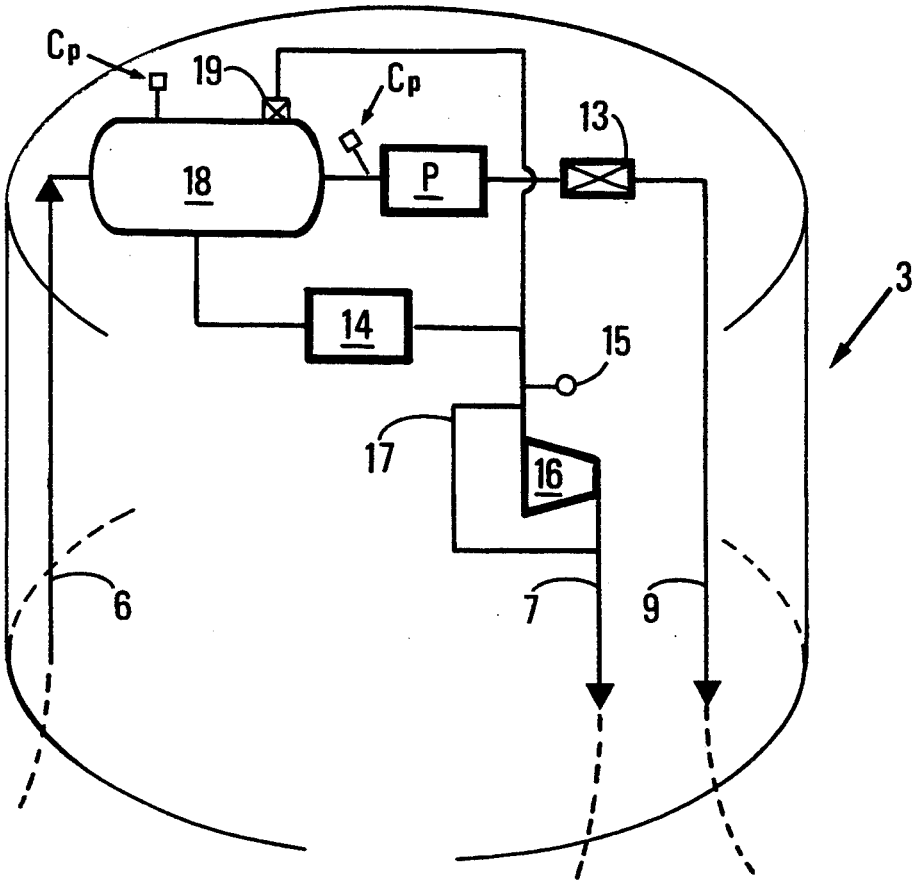
FIG. 4 shows an example of the embodiment of a device in which the gas may be taken at the outlet of a pump and/or at the level of a device for regulating the fluctuations of the effluents.

FIG. 4 shows an embodiment combining the flow diagrams of FIGS. 2 and 3.

In this case, the gaseous part of the effluent used to facilitate the upflow of the effluent may be taken at the outlet of pump P and/or at the level of regulating drum 18.

The fact of using one or the other of these sampling ways or both depends on the desired amount of gas.

The running of such a device is achieved according to a pattern described for example in connection with FIG. 2.

Of course, the process and the device which have been described by way of non limitative examples may be provided with various modifications and/or additions by the man skilled in the art without departing from the scope of the invention.

I claim:

1. A system for optimizing the development of oil-containing effluent fields located below a water layer and in communication with at least one production well, said system comprising, in combination, a main platform equipped with means for treating the effluents coming from said at least one production well, at least one floating structure, a pump assembly on the floating structure, said floating structure being substantially positioned close to at least one underwater wellhead of the at least one production well, first transfer means for transferring the effluents from at least one production well via the at least one underwater wellhead upwardly towards said floating structure and second transfer means for transferring effluents from the floating structure towards the main platform via said pumping assembly; at least one means on the floating structure for taking a fluid from said effluents and at least one injection line for injecting said fluid, said injection line comprising a first end connected to said at least one means on the floating structure and a second end located substantially at the level of the at least one underwater wellhead for injecting said fluid into the first transfer means, thereby facilitating upflow of the effluents.

2. A system as claimed in claim 1, wherein the second end of said fluid injection line is connected directly to a base of the first transfer means for transferring said effluents.

3. A system as claimed in claim 2, wherein the second end of said fluid injection line is connected to a base of the first transfer means for transferring said effluents by means of a device for regulating the flow of said injected fluid.

4. A system as claimed in claim 1, wherein the fluid taken from the effluents is part of a gas phase of said effluents and wherein said injection line for injecting said gas phase comprises a production umbilical line or a riser.

5. A system as claimed in claim 1, wherein said pumping assembly located on the floating structure includes at least one multiphase pump and wherein the first end of said fluid injection line is connected to an outlet of said pump.

6. A system as claimed in claim 1, wherein said floating-structure comprises at least one device for regulating and reducing fluctuations of gas and liquid phases of the effluents from the at least one production well and wherein the first end of said fluid injection line is connected to the device for regulating and reducing the fluctuations.

7. A system as claimed in claim 1, further comprising means for anchoring said floating structure close to an effluent field.

8. A method for developing and optimizing the development of oil containing effluent fields located below a water layer, said fields being in communication with at least one immersed wellhead of at least one production well, said method comprising the following stages:

positioning temporarily a floating structure close to at least one production well and transferring the effluents from said at least one production well towards the floating structure via first transfer means;

taking a gas phase from said effluents;

injecting said gas phase at a level of an immersed wellhead connected to the at least one production well, said injected gas phase favoring upflow of the effluents in said first transfer means; and transferring at least part of said effluents from the floating structure towards a main platform located at a distance from the floating structure.

9. A method as claimed in claim 8, wherein the first transfer means has a lower end and a upper end opposite the lower end, said gas phase being injected at the level of the lower end of the first transfer means, said lower end being connected to the at least one wellhead.

10. A method as claimed in claim 8, wherein the floating structure is equipped with a pumping assembly including at least one pump for transferring the at least part of said effluents towards the main platform and wherein the gas phase is taken from the effluents at an outlet of said pump.

11. A method as claimed in claim 8, wherein the floating structure is equipped with at least one device for regulating fluctuations of the gas phase and of a liquid phase within said effluents, the gas phase being taken from said at least one device.

* * * * *